US007624693B2

(12) United States Patent
Fabec

(10) Patent No.: US 7,624,693 B2
(45) Date of Patent: Dec. 1, 2009

(54) EMBROIDERY SEWING MACHINE HOOPING DEVICE

(75) Inventor: David F. Fabec, 1601 Camino de la Sierra, NE., Albuquerque, NM (US) 87112

(73) Assignee: David F. Fabec, Albuquerque, NM (US)

( * ) Notice: Subject to any disclaimer, the term of this patent is extended or adjusted under 35 U.S.C. 154(b) by 314 days.

(21) Appl. No.: 10/779,023

(22) Filed: Feb. 13, 2004

(65) Prior Publication Data

US 2005/0178031 A1 Aug. 18, 2005

(51) Int. Cl.
*D05C 9/04* (2006.01)
*D05B 21/00* (2006.01)

(52) U.S. Cl. ..... 112/470.18; 112/103; 112/470.14; 38/102.2

(58) Field of Classification Search ..... 112/103, 112/119, 475.11, 470.14, 475.18, 470.18; 38/102.2

See application file for complete search history.

(56) References Cited

U.S. PATENT DOCUMENTS

| | | | | | |
|---|---|---|---|---|---|
| 4,357,885 | A * | 11/1982 | Stockton | 112/103 |
| 4,762,076 | A * | 8/1988 | Wakaizumi | 112/103 |
| 4,774,778 | A * | 10/1988 | Williams | 38/102.2 |
| 5,144,899 | A * | 9/1992 | Allen | 112/103 |
| 5,546,877 | A * | 8/1996 | Moore | 112/103 |
| 5,630,370 | A * | 5/1997 | Herbach | 112/103 |
| 5,884,571 | A * | 3/1999 | Valadez et al. | 112/103 |
| 5,970,895 | A * | 10/1999 | Mack | 112/103 |
| 6,457,428 | B1 * | 10/2002 | Vickroy | 112/103 |
| 6,640,735 | B2 * | 11/2003 | Kwang | 112/475.18 |
| 6,775,934 | B1 * | 8/2004 | Gallik et al. | 38/102.2 |
| 6,832,569 | B2 * | 12/2004 | Krasnitz | 112/475.18 |

* cited by examiner

*Primary Examiner*—Ismael Izaguirre
(74) *Attorney, Agent, or Firm*—David Frank Fabec

(57) ABSTRACT

An embroidery sewing machine hooping device has an attachment bracket attached to a base formed to suit each size and shape of machine embroidery hoop. The base provides a stable platform while hooping material and is equipped with a non-skid or non-slip material limiting side-to-side slippage when hooping materials.

1 Claim, 1 Drawing Sheet

FRONT VIEW

TOP VIEW

REAR VIEW

EMBROIDERY SEWING MACHINE HOOPING DEVICE

BACKGROUND AND SUMMARY OF THE INVENTION

The present invention pertains to the hooping of fabrics to a pair of embroidery hoops (inner and outer). Fabric is held in place between inner and outer hoops while machine embroidery occurs. Therefore, in the past, hooping fabrics were held around the periphery of the inner hoop with the desired target oriented to a manufacturer's grid. The outer hoop was placed on a work surface while the held fabric and inner hoop were inserted into the outer hoop which being unsecured would slip causing difficulty in maintaining the desired pattern target position. In the present invention, however, the outer hoop is securely mounted to a base and bracket. The base has a non-slip material secured to the undersurface and a bracket to receive the clamping mechanism of the outer hoop. The operator then inserts the inner hoop and fabric into the stabilized outer hoop and the adjustment mechanism of the outer hoop is readily accessible due to the height of the base from work surface and when tightened, the assembled hoops and fabric can then be removed from the hooping device and mounted to the embroidery machine; thus the hooping accuracy of the fabric target position can be more easily maintained and accomplished.

In the preferred embodiments the undersurface of the base is preferably formed from a latex material.

It is therefore an object of the present invention to provide an improved device for hooping fabrics for embroidery machines.

Another object of the present invention to provide a device that enables operators with hand infirmities (arthritis) to easily accomplish the hooping operation.

A fuller understanding of the invention will become apparent from reading the following description of a preferred embodiment along with the accompanying drawings in which.

DETAILED DESCRIPTION OF A PREFERRED EMBODIMENT

Figure 1:
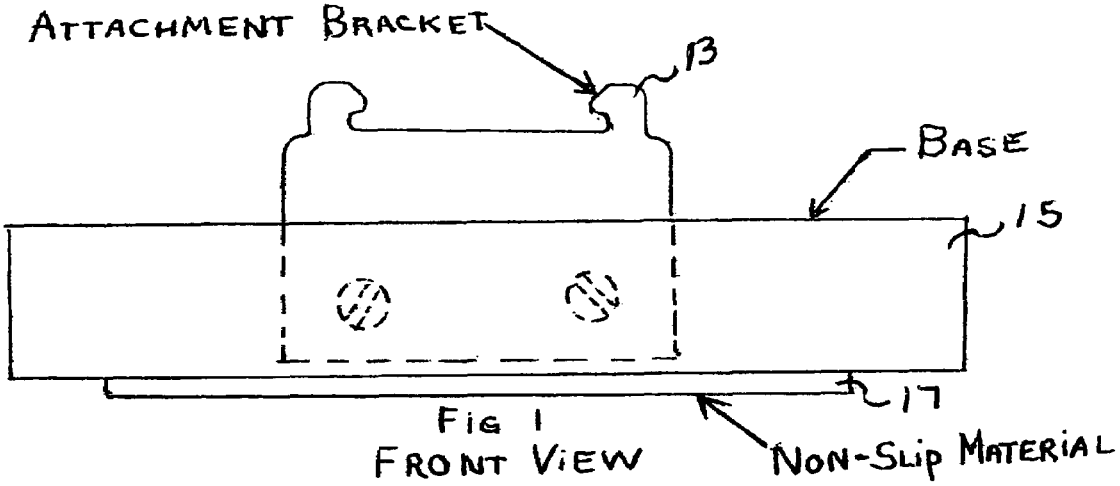
FIG. 1 is a front view of a hooping device typical type for attaching the manufacturer's outer hoop to the bracket 13 and base 15.

Turning now to the drawings, and referring to FIG. 1, there is illustrated an attachment bracket 13 similar in design to a present manufacturer's embroidery machine's attachment hardware for securing the outer hoop to the embroidery machine. Bracket 13 is customized to each manufacturer's outer hoop attachment hardware and can be formed from metals or plastics. Also illustrated in FIG. 1 is non-slip material 17. The non-slip material is adhered to the undersurface of base 15 with adhesive. The non-slip material 17 can be formed from latex, rubber or plastic.

Figure 2:
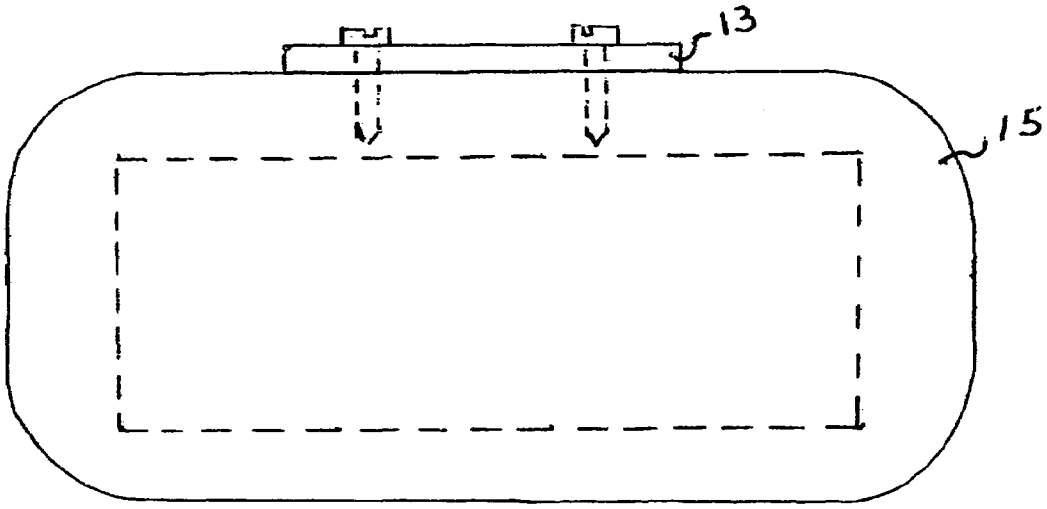
FIG. 2 is a top view of a hooping device depicting a base of typical size and shape of outside contour of the manufacturer's outer hoop.
Figure 3:
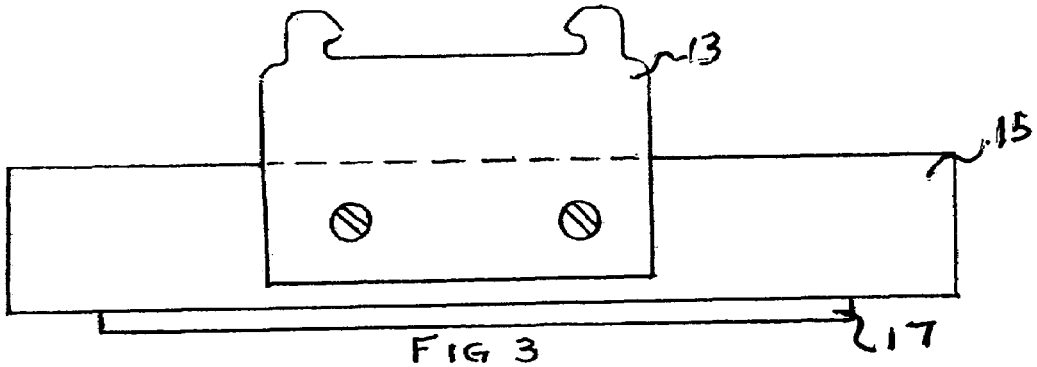
FIG. 3 is a rear view of a hooping device depicting a typical method of securing the attachment bracket 13 to the base 15.

Turning now to FIG. 2 base 15 there is illustrated a typical shape of the outer contour of a present manufacturer's outer hoop. Base 15 is formed to the size and shape of each manufacturer's outer hoops and can be formed from wood, metal or plastics; the thickness or height of base 15 will provide adequate space from work surface for an operator's tightening of the outer hoop hardware.

A description of the procedures of utilizing the present invention reveals the advantages such that simply attaching the outer hoop to the bracket on the non-slip, nonskid base in the same manner that it attaches to the embroidery machine provides for a stabilized platform for insertion of the inner hoop and targeted fabric. Further the outer hoop adjustment can be attained without having to move the project to access the adjustment mechanism.

Therefore there is described herein an improved device for hooping fabrics in usually one attempt and enhancing the ability of operators with infirmities (arthritis) in this effort.

I claim:

1. A holding device for outer hoops of embroidery machines having various hoop sizes, shapes and outer hoop attachment hardware; said device comprising a base configured to each manufacturer's outer hoop size, shape and attachment hardware; wherein said holding device comprises non-slip material adhered to bottom of base eliminating slippage between the outer hoop and work surface improving holding and positioning fabrics to desired pattern target.

* * * * *